US005133334A

United States Patent [19]

Riehl

[11] Patent Number: 5,133,334

[45] Date of Patent: Jul. 28, 1992

[54] BURNER CONSTRUCTION AND METHOD OF MAKING THE SAME

[75] Inventor: Fred Riehl, Greensburg, Pa.

[73] Assignee: Robertshaw Controls Company, Richmond, Va.

[21] Appl. No.: 815,725

[22] Filed: Dec. 30, 1991

Related U.S. Application Data

[62] Division of Ser. No. 613,406, Nov. 15, 1990, Pat. No. 5,085,202, which is a division of Ser. No. 448,935, Dec. 12, 1989, Pat. No. 5,002,038.

[51] Int. Cl.[5] ..... F24C 3/00

[52] U.S. Cl. ..... 126/39 R; 239/552; 239/567

[58] Field of Search ..... 126/39 R, 39 H, 39 N, 126/39 K; 431/264, 266; 239/552, 567

[56] References Cited

U.S. PATENT DOCUMENTS

| | | | |
|---|---|---|---|
| 873,182 | 12/1907 | Springer et al. | 239/567 |
| 1,004,291 | 9/1911 | Merrill | 239/552 |
| 1,354,295 | 9/1920 | Hamilton | 239/552 |
| 4,518,346 | 5/1985 | Pistien | 431/266 |
| 4,773,383 | 9/1988 | Le Monnier de Gouville | 431/354 |
| 4,846,671 | 7/1989 | Kwiatek | 431/266 |

*Primary Examiner*—Carroll B. Dority

*Attorney, Agent, or Firm*—Candor, Candor & Tassone

[57] ABSTRACT

A burner construction and method of making the same are provided, the burner construction comprising a burner body having a chamber therein and having opposed ends one of which is open to the chamber and the other of which has structure for interconnecting a source of fuel to the chamber, and a removable cap closing the one end of the body, the burner construction having ports interconnecting the chamber to the exterior of the burner construction and through which the fuel can issue to burn externally to the burner construction, the burner construction comprising a removable venturi section disposed in the chamber and being removable therefrom through the open end of the body when the cap has been removed therefrom.

6 Claims, 5 Drawing Sheets

BURNER CONSTRUCTION AND METHOD OF MAKING THE SAME

BACKGROUND OF THE INVENTION

1. Field of the Invention

This invention relates to a new burner construction and to a new method of making such a burner construction.

2. Prior Art Statement

It is known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction. For example, see the U.S. Pat. to Kwiatek, No. 4,846,671.

It is also known to provide a burner construction comprising a burner body means having a chamber means therein and having opposed end means one of which is open to the chamber means and the other of which has means for interconnecting a source of fuel to the chamber means, a removable cap means closing the one end means of the body means, the burner construction having port means interconnecting the chamber means to the exterior of the burner construction and through which the fuel can issue to burn externally to the burner construction, the body means having opening means therethrough leading to the chamber means for directing primary air from the exterior of the burner construction into the chamber means, and an adjustable shutter means carried by the body means and being movable relative thereto to control the effective area of the opening means that is exposed to the primary air. For example, see the aforementioned U.S. Pat. to Kwiatek, No. 4,846,671.

SUMMARY OF THE INVENTION

It is one feature of this invention to provide a new burner construction that achieves an acceptable fuel injection and mixing means that will exhibit a flame pattern and port velocity that is stable and predictable throughout gas pressure variables of the environment in the applications thereof by providing a venturi arrangement that has an optimum throat area for various burner inputs when desired through an interchangeability of the venturi arrangement.

In particular, it was found according to the teachings of this invention that the burner body of the burner construction can be so constructed and arranged that a removable venturi section can be disposed in the chamber means for the above purpose and be readily removable therefrom by merely removing a removable cap means from the burner body.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the burner construction comprising a removable venturi section disposed in the chamber means and being removable therefrom through the open end means of the body means when the cap means has been removed therefrom.

It is another feature of this invention to provide a burner construction wherein the shutter means for the primary air intake means thereof can be readily adjusted from one end of the burner construction.

In particular, it was found according to the teachings of this invention that the burner body of a burner construction can have an open end through which an adjustment of the shutter means can be made when the cap means thereof is removed therefrom and when the shutter means has means that is accessible in the chamber means of the body means.

For example, another embodiment of this invention comprises a burner construction comprising a burner body means having a chamber means therein and having opposed end means one of which is open to the chamber means and the other of which has means for interconnecting the source of fuel to the chamber means, a removable cap means closing the one end means of the body means, the burner construction having port means interconnecting the chamber means to the exterior of the burner construction and through which the fuel can issue to burn externally to the burner construction, the body means having opening means therethrough leading to the chamber means for directing primary air from the exterior of the burner construction into the chamber means, and an adjustable shutter means carried by the body means and being movable relative thereto to control the effective area of the opening means that is exposed to the primary air, the shutter means having means that is accessible in the chamber means for adjusting the shutter means whereby the shutter means can be adjusted through the open end means of the body means when the cap means has been removed therefrom.

It is another feature of this invention to provide a burner construction wherein the port means thereof for issuing fuel are uniquely formed therein.

In particular, it was found according to the teachings of this invention that one of the body means and the cap means of the burner construction can have an annular surface means that is interrupted by a plurality of radially disposed and spaced apart groove means that can be closed by an annular surface means on the other of the body means and the cap means to form the port means for the burner construction.

For example, another embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, one of the body means and the cap means having an annular surface means interrupted by a plurality of radially disposed and spaced apart groove means, the other of the body means and the cap means having an annular surface means cooperating with the annular surface means that has the groove means therein to close the groove means on one end thereof whereby the groove means define the port means of the burner construction.

Accordingly, it is an object of this invention to provide a new burner construction having one or more of the novel features of this invention as set forth above or hereinafter shown or described.

Another object of this invention is to provide a new method of making such a burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
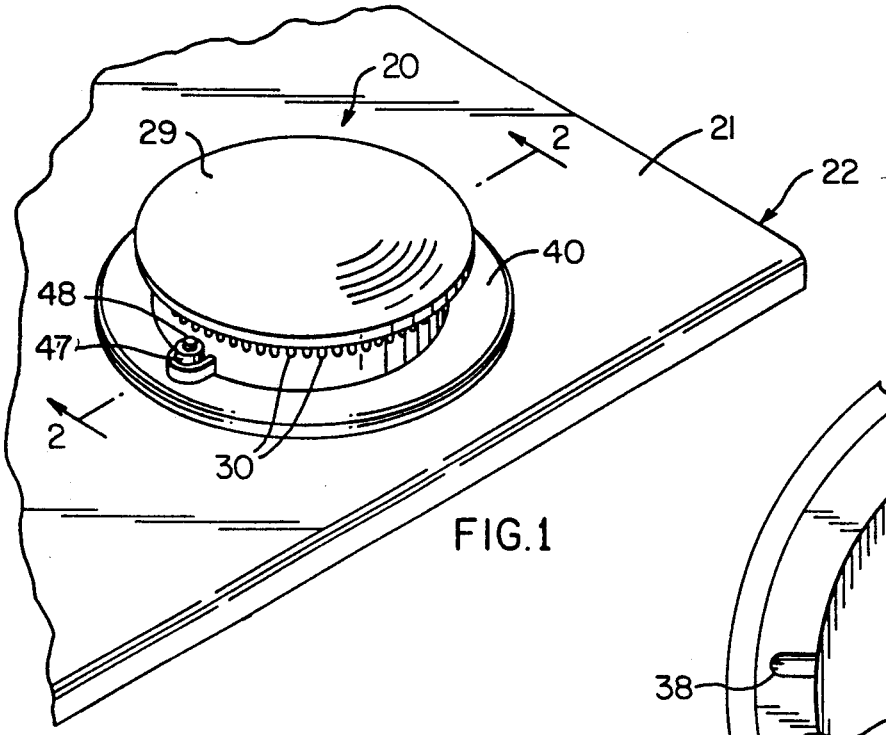
FIG. 1 is a fragmentary top view illustrating the new burner construction of this invention mounted in a range top of a cooking apparatus.
Figure 3:
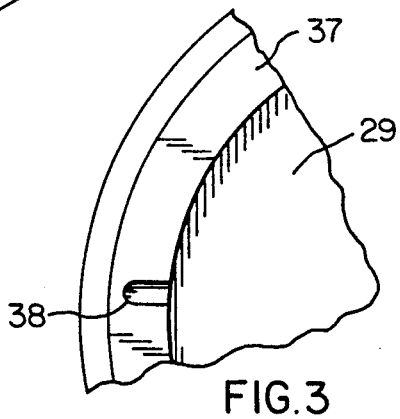
FIG. 3 is a fragmentary cross-sectional view taken on line 3—3 of FIG. 2.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

Figure 2:
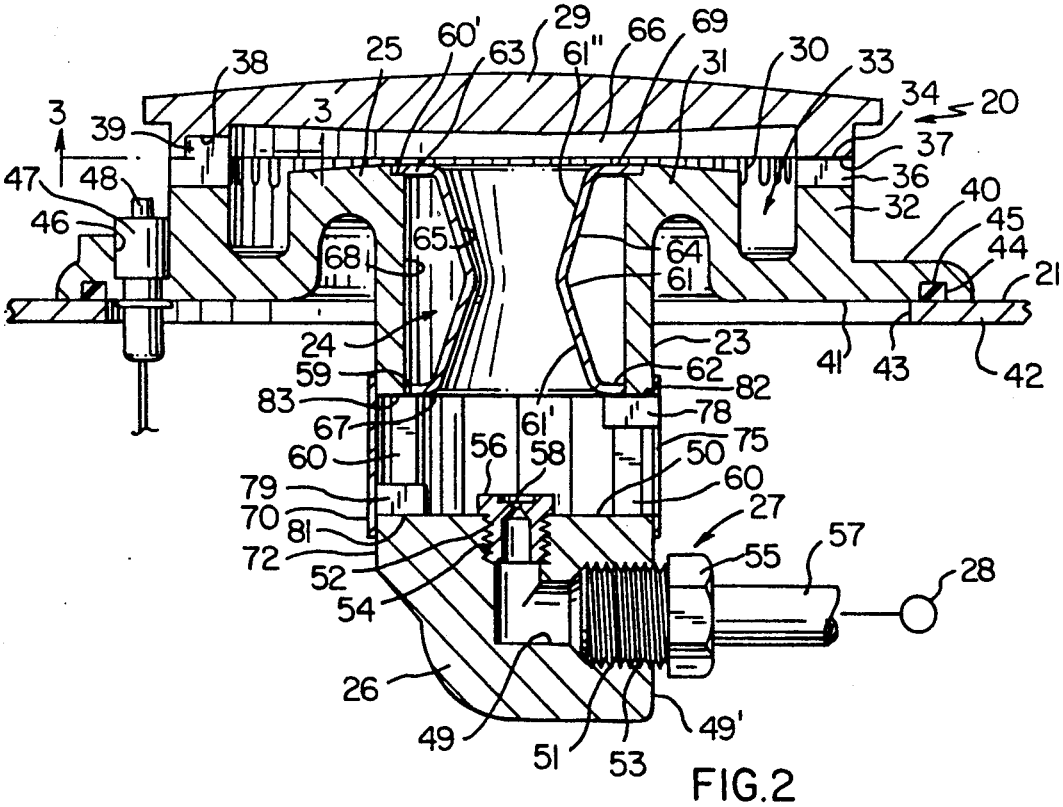
FIG. 2 is an enlarged fragmentary cross-sectional view taken on line 2—2 of FIG. 1.

Referring now to FIGS. 1 and 2, the new burner construction of this invention is generally indicated by the reference numeral 20 and is illustrated as being sealed to a range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a source 28 of fuel with the chamber means 24 in a manner hereinafter set forth.

The burner construction 20 comprises a removable cap means 29 closing the open end means 25 of the body means 23, the burner construction 20 having a plurality of port means 30 interconnecting the chamber means 24 to the exterior of the burner construction 20 and through which fuel can issue to burn externally to the burner construction 20 in a manner well known in the art. For example, see the aforementioned U.S. Pat. to Kwiatek, No. 4,846,671, whereby this patent is being incorporated into this disclosure by this reference thereto.

While the body means 23 and cap means 29 of the burner construction 20 can be formed of any suitable material or combinations of materials, such as metallic materials, one working embodiment thereof has the body means 23 and cap means 29 each formed of die cast aluminum RMS-105 with the body means 23 being a one-piece member and with the open end means 25 thereof being defined by a first annular portion 31 surrounded by a second annular portion 32 disposed substantially concentrically therewith and spaced therefrom by an annular groove means 33 as illustrated.

Figure 4:
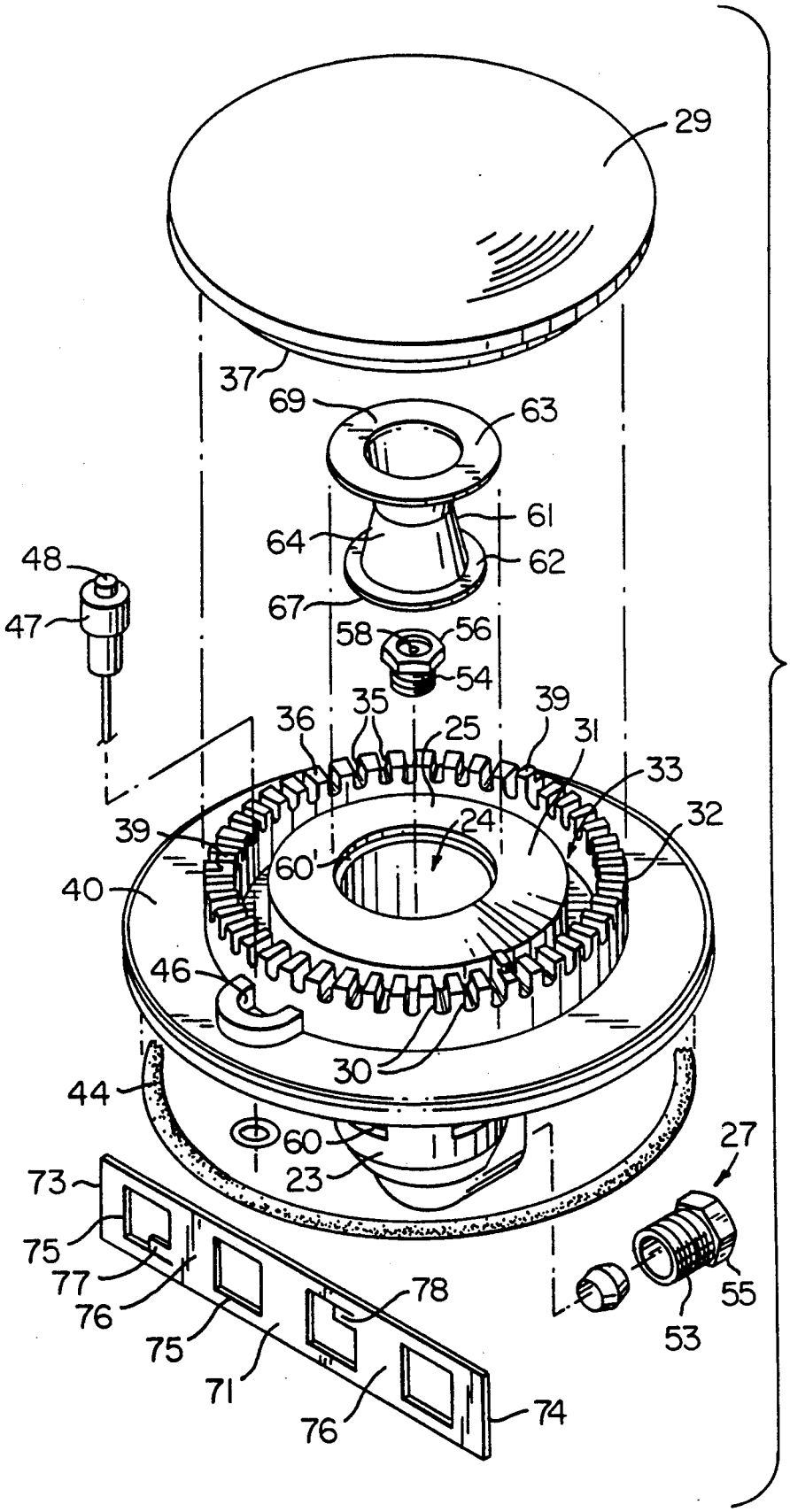
FIG. 4 is an exploded perspective view of various parts of the burner construction of FIGS. 1-3.
Figure 5:
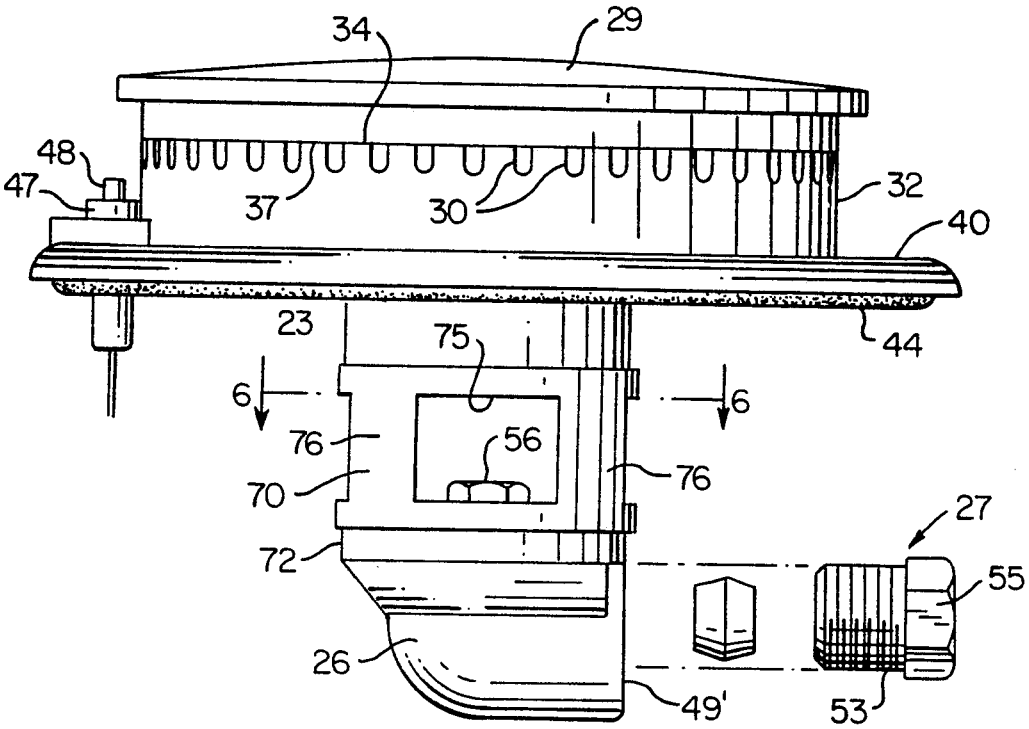
FIG. 5 is a side elevation view of the burner construction of FIG. 2 with certain parts thereof exploded therefrom.

The outer annular portion 32 of the body means 23 has an annular substantially flat top surface means 34 interrupted by a plurality of radially disposed and spaced apart U-shaped grooves 35 disposed in the circular array as illustrated in FIG. 4 and being adapted to be respectively closed at the open ends 36 thereof by a substantially flat annular surface 37 on the cap means 29 in the manner illustrated in FIG. 2 to form the port means 30 previously set forth, the annular surface 37 of the cap means 29 having a plurality of notches 38 formed therein to respectively receive locating projections 39 on the annular surface 34 of the body means 23 in the manner illustrated in FIG. 2 so as to orient the cap means 29 relative thereto and prevent the cap means 29 from slipping off the body means 23 when the same has been assembled thereto in the manner illustrated in FIGS. 1 and 2.

The body member 23 has an outwardly directed annular flange 40 provided with a substantially flat annular surface 41 for engaging against the range top surface 21 of a range top structure 42 that has an opening 43 passing therethrough and in which the body member 23 projects as illustrated in FIG. 2 so as to be suspended in the opening 43 by the surface 41 engaging against the range top surface 21.

The annular flange 40 is adapted to be sealed to the range top surface 21 by an annular sealing member 44 that is disposed in an annular groove 45 formed in the annular surface 41 of the flange 40 of the body means 23 of the burner construction 20 in the manner illustrated in FIGS. 2 and 4, the annular flange 40 being secured to the range top structure 42 in any suitable and/or conventional manner, such as by having projections (not shown) on the flange 40 snap-fitting into suitable spring clip means (not shown) carried by the range top structure 42.

If desired, the annular flange 40 of the body means 23 can be provided with suitable opening means 46 passing therethrough and receiving an electrode assembly 45 for sparking from an electrode 48 thereof to the burner construction 20 and thereby igniting fuel issuing out of the port means 30 adjacent thereto in a manner well known in the art whereby a further discussion of the details and the operation of the electrode assembly 47 need not be set forth.

The means 27 for interconnecting the source 28 of fuel to the chamber means 24 of the burner body means 23 comprises a passage means 49 formed through the closed end means 26 of the burner body means 23 with the passage means 49 interrupting an external side surface 49' of the end means 26 as well as a substantially flat interior end wall means 50 of the end means 26, the passage means 49 being internally threaded at 51 and 52 respectively at the opposed ends thereof and respectively being adapted to receive threaded portions 53 and 54 of members 55 and 56.

The member 55 comprises a conduit coupling member or means which couples a conduit means 57 that leads from the source 28 of fuel to the passage means 49 and the member 56 comprising an input orifice member having an orifice 58 for controlling the amount of fuel being permitted to enter the chamber means 24 as is well known in the art.

It is to be understood that the conduit means 57 has suitable and conventional control means (not shown) therein for connecting and disconnecting the source 28 of fuel to and from the passage means 49 in a manner well known in range top art.

The burner body means 23 has a first internal annular shoulder means 59 disposed in spaced parallel relation above the interior wall means 50 thereof, the body means 23 having a plurality of side openings 60 formed therethrough intermediate the shoulder means 59 and the interior wall means 50 for a purpose hereinafter described.

The burner body means 23 has a second annular shoulder means 60 disposed in spaced parallel relation above the first annular shoulder means 59 and interrupting the annular portion 31 of the open end 25 thereof, the annular shoulder 60 being in aligned relation with the annular shoulder 59 and having a greater diameter for a purpose hereinafter set forth.

A removable venturi section 61 of this invention is adapted to be disposed in the chamber means 24 through the open end means 25 thereof when the cap means 29 is removed from the body means 23, the venturi section 61 having opposed outwardly directed annular end flanges 62 and 63 and an hourglass shaped intermediate portion 64 that provides a venturi throat 65 through which fuel must flow from the orifice member 56 to the open end 25 of the burner body 23 and into the space 66 disposed between the portion 31 of the end means 25 of the burner body 23 and the end cap 29 so as to flow to the ports 30 and issue out of the same as is readily apparent when viewing the burner construction 20 of this invention in FIG. 2.

The annular flange 62 at one end 67 of the venturi section 61 has a diameter that permits the same to pass downwardly through an internal cylindrical portion 68 of the chamber means 24 and rest against the annular shoulder 59 as illustrated in FIG. 2 while the annular flange 63 at the other end 69 of the venturi section 6; has a diameter that is too great to be received in the cylindrical portion 68 of the chamber means 24 but is adapted to rest on the annular shoulder 60 as illustrated in FIG. 2 when the venturi section 61 has its lower flange 62 resting on the shoulder 59.

In this manner the venturi section 61 can only be disposed in the chamber means 24 of the burner body means 23 with the end means 67 thereof being first inserted into the chamber means 24 as the end means 69 cannot be first inserted into the chamber means 64 through the oversize of the flange 63 thereof relative to the cylindrical portion 68 of the chamber means 24. This, or course, insures proper insertion of the venturi section 61 either during initial assembly of the burner construction 20 or during subsequent removal and replacement of the same or different venturi section 61 as the case may be.

The openings 60 in the burner body 23 provide primary air that is adapted to be drawn into the chamber means 24 of the burner body means 23 to mix with the fuel issuing out of the orifice 58 of the orifice member 56 before the same enters the end 67 of the venturi section 61.

Figure 6:
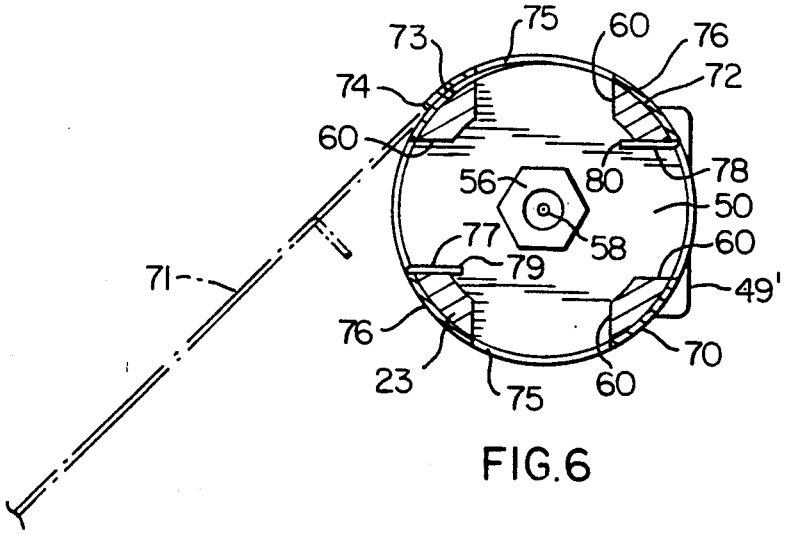
FIG. 6 is a cross-sectional view taken on line 6—6 and illustrating in phantom lines how the adjustable shutter means can be assembled thereto.

In order to control the area of the openings 60 providing such primary air, an adjustable shutter means 70 of the burner construction 20 is provided and comprises an annular sheet metal member 71, such as stainless steel, being disposed in an annular spring gripping frictional manner about the exterior peripheral surface 72 of the burner body means 23 and having opposed ends 73 and 74 disposed in closely spaced apart relation or overlapping relation as illustrated in FIG. 6. The sheet metal member 71 has a plurality of opening 75 formed therethrough in spaced apart relation by unblanked portions 76 of the member 71, the member 71 having a pair of bent integral tabs 77 and 78 respectively disposed at the bottom and top of a pair of openings 75 therof so that when the strip 71 is disposed in an annular manner and then spread about the burner body means 23, the tabs 77 and 78 respectively enter through the respective openings 60 in the burner body means 23 to have the free ends 79 and 80 thereof respectively disposed in the chamber means 24 as illustrated in FIGS. 6, 7 and 8.

It can be seen that the tab 77 has its lower surface 81 adapted to engage against the flat interior end wall 50 of the end means 29 of the burner body means 23 while the other tab means 78 has its upper surface 82 adapted to abut against the under surface 83 of the burner body means 23 that defines the top of the slots 60 as illustrated in FIG. 2.

Figure 7:
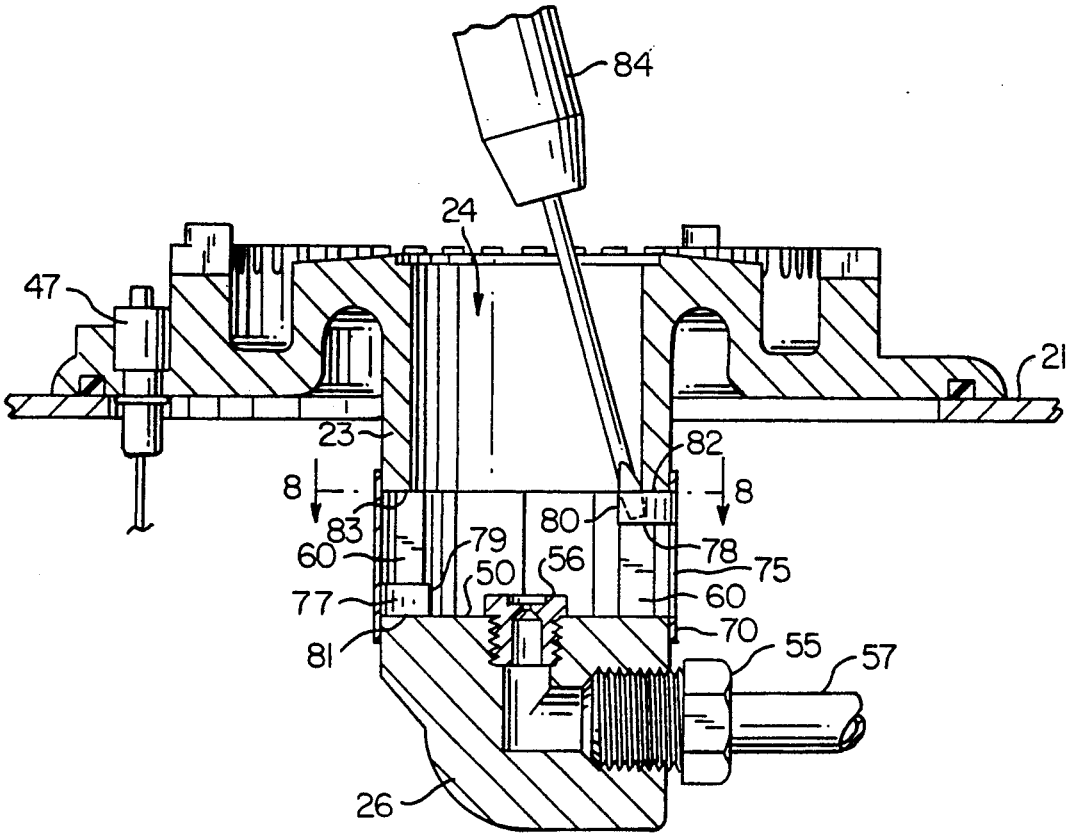
FIG. 7 is a view similar to FIG. 3 and illustrates how the adjustable shutter means can be adjusted after the cap means and venturi section of the burner construction have been removed.
Figure 8:
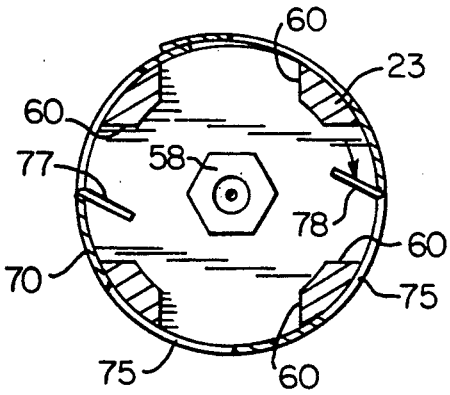
FIG. 8 is a cross-sectional view taken on line 8—8 of FIG. 7.

In this manner, the tabs 77 and 78 positively locate the shutter means 70 in its telescoped relation on the burner body means 23 so that the same cannot move axially up and down on the same but permits the shutter means 70 to be rotated within the limits of the tab means 77 and 78 being moved to the extreme ends of the respective openings 60 through which the same project Thus, it is a relatively simple method of this invention to adjust the effective area of openings 60 that the shutter means 70 permits the primary air to flow through into the chamber means 24 by simply lifting the end cap means 29 from the burner body 23 and removing the venturi section 61 by lifting the same out of the chamber means 24 through the now opened end 25 thereof and inserting a finger or a small screwdriver, such as screwdriver 84 in FIG. 7, and engage against one of the free ends 79 or 80 of the tabs 77 and 78 to rotate the shutter means 70 in either direction to either cover more of the openings 60 with the unblanked portions 76 thereof or uncover more of the openings 60 with the openings 75 thereof as the case may be whereby the venturi section 61 can then be replaced in its assembled position in the chamber means 24 and the end cap 29 can be disposed on the burner body 29 to reassemble the same in the manner illustrated in FIG. 2.

Thus, it can be seen that it is a relatively simple method of this invention to make the burner construction 20 of this invention which is adapted to operate in a manner now to be set forth.

When it is desired to utilize the burner construction 20 with the cooking apparatus 22, the same can be inserted in an appropriate opening 43 in the range top 42 and be sealed thereto by the annular sealing means 44, the annular flange 40 being secured to the range top 42 in any suitable manner, such as by spring clips, etc., previously described. In any event, it can be seen that the end 26 of the burner body means 23 is disposed beneath the range top structure 42 and is then interconnected to the fuel source 28 by the conduit means 57 in a conventional manner.

Thus, fuel is adapted to be directed into the passage means 49 by the control device of the conduit means 57 to issue out of the orifice means 56 into the area of the chamber means 24 below the end 67 of the venturi section 61 to mix with primary air being drawn into the chamber 24 through the uncovered openings 60 thereof as previously set forth whereby the primary air and fuel pass through the throat 65 of the venturi section 61 to issue out of the ports 30 of the burner construction 20 to be ignited by the electrode means 48 sparking in a conventional manner.

Such burner construction 20 has been found to provide excellent combustion with both natural gas and LP fuel while surviving on very limited secondary aeration adjacent the ports 30 thereof when the burner construction 20 has been used in a sealed installation similar to that shown in FIGS. 1 and 2. However, as previously set forth, the burner construction 20 of this invention is not to be limited to only a sealed burner arrangement as the same can be used in nonsealed burner arrangements.

However, when the burner construction 20 is utilized in a sealed burner arrangement thereof, it can be seen that constraints of dimensional height and fuel inlet approaches have been overcome to achieve an acceptable fuel injection and mixing means that exhibit a flame pattern and port velocity that is stable and predictable throughout the gas pressure variables of the environment in such applications.

Should it be desired to change the venturi section 61 and/or change the amount of the effective area of the openings 60 for the primary air of the burner construction 20, the cap means 29 can be lifted from the burner body 23 while the same is in its installed condition of FIGS. 1 and 2 and then the venturi section 61 can be removed out through the now opened end 25 of the burner body means 23 to have another venturi section 61 with a different throat configuration thereof disposed therein and/or the shutter means 70 can be adjusted in the manner illustrated in FIG. 7 as previously set forth. In addition, should it be desired to provide a different orifice member 56, such orifice member 56 can be unthreaded from the threaded portion 52 of the passage means 49 by inserting a suitable tool through the opened end 25 of the burner construction 23 and a new orifice member 56 can then be threaded therein before the venturi section 61 is replaced above the same. Thereafter, the end cap 29 can be disposed on the open end 25 of the burner body means 23 in the manner illustrated in FIGS. 1 and 2 to complete the reassembling operation of the burner construction 20.

Figure 9:
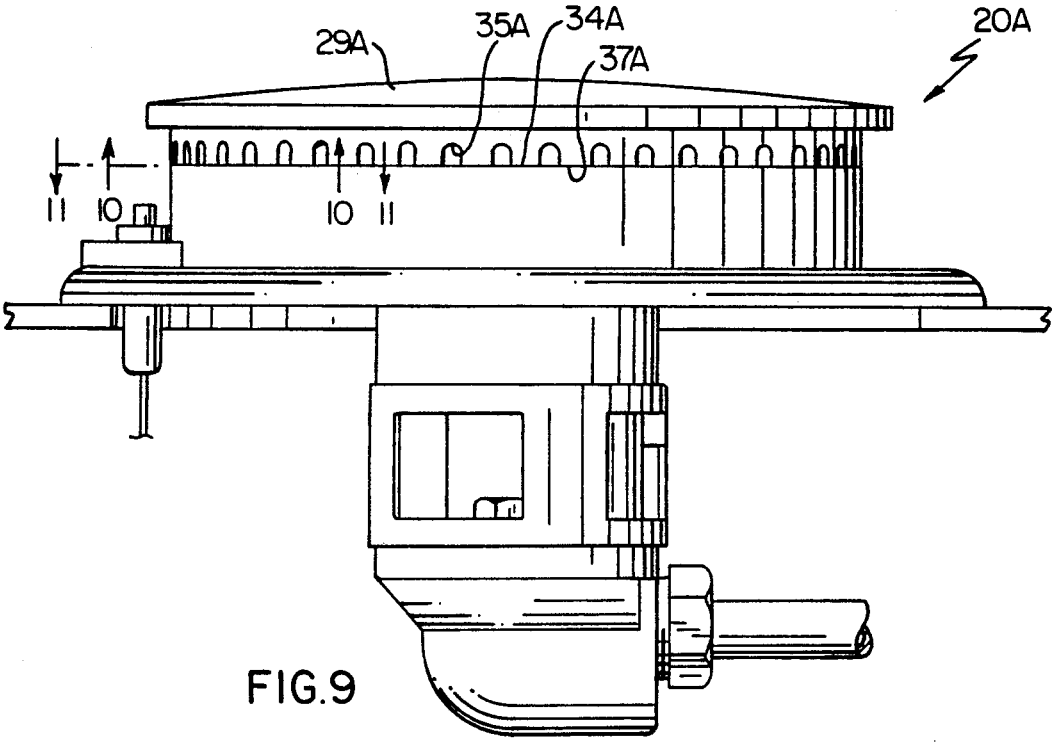
FIG. 9 is a side elevation view of another burner construction of this invention, FIG. 9 illustrating the burner construction mounted to a range top of a cooking apparatus.
Figure 10:
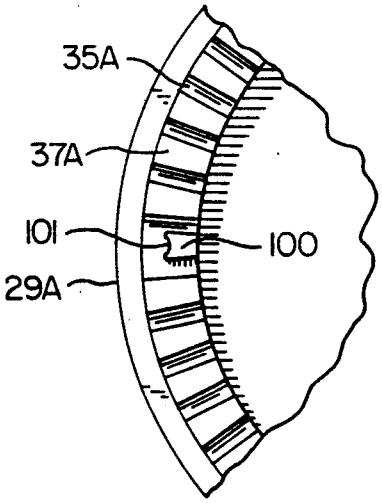
FIG. 10 is a fragmentary cross-sectional view taken on line 10—10 of FIG. 9.
Figure 11:
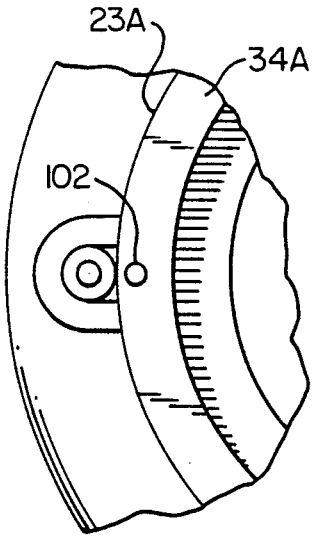
FIG. 11 is a fragmentary cross-sectional view taken on line 11—11 of FIG. 9.

Another burner construction of this invention is generally indicated by the reference numeral 20A in FIGS. 9, 10 and 11 and parts thereof similar to the burner construction 20 previously described are indicated by like reference numerals followed by the reference letter "A".

As illustrated in FIGS. 9–11, the burner construction 20A is substantially identical to the burner construction 20 previously described except that the U-shaped grooves 35 that were formed in the annular surface 34 of the burner body means 23 are formed in the annular surface 37A of the end cap means 29A to be closed by the substantially flat annular surface 34A of the burner body means 23A as illustrated.

In addition, the annular surface 37A of the end cap 29A has a plurality of projections 100 respectively provided with arcuate sides 101 which are adapted to locate against rounded pin-like projections 102 that extend from the flat annular surface 34A of the burner body means 23A as illustrated in FIG. 11 in contrast to the projections 39 and locating grooves 38 of the burner construction 20.

In any event, it can be seen that this invention permits the U-shaped openings or slots 35 or 35A to be formed in one of the members 23 or 29A and then be closed by the other cooperating member 29 or 23A as the case may be.

In one working embodiment of this invention, the U-shaped grooves 35 or 35A are each approximately 0.093 of an inch wide at the throat thereof, has a depth of approximately 0.113 of an inch and has the closed end thereof being defined on a radius of approximately 0.0465 of an inch. There are forty-five uniformly spaced apart U-shaped slots 35 or 35A with the outside diameter of the annular surface 34 or 37A having such grooves being approximately 3.500 inches and an inside diameter of approximately 3.000 inches whereby each groove 35 or 35A has its center disposed on a radius that is approximately 8° from the center of the next adjacent groove 35 or 35A.

The burner body 23 or 23A of such one working embodiment is approximately 1.873 of an inch from the surface 34 or 34A thereof to the center line of the threaded portion 51 of the passage means 49 thereof, the external peripheral surface 72 having a diameter of approximately 1.500 inches with the openings 60 each having a height of approximately 0.500 of an inch and a width of approximately 0.700 of an inch. There can be four openings 60 as illustrated or one opening 60 can be eliminated, as desired.

However, it is to be understood that the dimensions given above and hereinafter are merely set forth for the purposes of illustrating one working embodiment of this invention without being a limitation on this invention as it is believed that other dimensions can be utilized and still function in the desired manner.

In this regard, one working embodiment of the venturi section 61 that is utilized with the one working embodiment of the burner construction 20 previously set forth has a distance of approximately 0.875 of an inch between the end flanges 62 and 63 thereof with the diameter of the throat 65 being approximately 0.437 of an inch and being located approximately 0.437 of an inch from the end flange 63 thereof. The venturi section 61 has the frusto-conical passage 61' between the flange 62 and throat 65 defined by an angle of approximately 20° relative to the longitudinal axis of the venturi section 61 whereas the frusto-conical passage 61'' between the flange 63 and the throat 65 is approximately 17° relative to the longitudinal axis of the venturi section 61. The venturi section 61 is formed of aluminized steel tubing RMS-302 that is approximately 0.035 of an inch thick. Alternately, the venturi section can be shaped from aluminum tubing, if desired.

The one working embodiment of the shutter means 72 is formed from a strip of stainless steel RMS-407 that is approximately 0.012 of an inch thick, approximately 4.710 inches long and approximately 0.800 of an inch wide, the openings 75 thereof are approximately 0.731 of an inch wide and approximately 0.500 of an inch tall. The tabs 77 and 78 are each approximately 0.200 of an inch long and approximately 0.010 of an inch wide.

By casting either the end cap or burner body means with the U-shaped grooves for forming the ports of the resulting burner construction, good tolerances can be maintained in contrast to forming openings through a steel part whereby the part of this invention that has the U-shaped grooves 35 or 35A can be cast aluminum and the part cooperating therewith, such as the end cap 29 or the burner body means 23A, can then be formed of steel or other material and close the open ends of such U-shaped grooves 35 or 35A.

Thus, it can be seen that this invention provides a new burner construction and a new method of making such a burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a burner construction comprising a burner body means having a chamber means therein, said burner body means having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, the improvement wherein said body means has an annular surface means interrupted by a plurality of radially disposed and spaced apart U-shaped groove means with each groove means having a rounded end and substantially straight and parallel sides terminating at said annular surface means at the other end thereof, said cap means having an annular surface means cooperating with said annular surface means of said burner body means to close said groove means on said other end thereof whereby said groove means define said port means, said body means having a shoulder means in said chamber means, and a removable venturi section disposed in said chamber means and having an upper end resting on said shoulder means to support said venturi section on said body means.

2. A burner construction as set forth in claim 21 wherein each said groove means has a width of approximately 0.093 of an inch between said sides thereof at said one end thereof, a depth of approximately 0.113 of an inch between said ends thereof and a radius of approximately 0.0465 of an inch at said rounded end thereof.

3. A burner construction as set forth in claim 1 wherein said burner body means has orienting means cooperating with said cap means to coaxially orient said cap means on said burner body means.

4. A burner construction as set forth in claim 3 wherein said orienting means of said burner body means comprise a plurality of spaced apart projection means.

5. A burner construction as set forth in claim 4 wherein said projection means of said burner body means extend beyond said annular surface means thereof toward said cap means.

6. A burner construction as set forth in claim 4 wherein said projection means of said burner body means are disposed in a circular array thereof.

* * * * *

UNITED STATES PATENT AND TRADEMARK OFFICE

CERTIFICATE OF CORRECTION

PATENT NO. : 5,133,334

DATED : July 28, 1992

INVENTOR(S) : Fred Riehl

It is certified that error appears in the above—identified patent and that said Letters Patent is hereby corrected as shown below:

On the title page, Item [56], insert the following:
The term of this patent subsequent to March 26, 2008, has been disclaimed.

Column 1 between lines 3 and 4, insert the following heading and paragraph:

--CROSS REFERENCE TO RELATED APPLICATION

This application is a divisional patent application of its copending parent patent application, Serial No. 613,406, filed November 15, 1990, which, in turn is a divisional patent application of its copending parent patent application, Serial No. 448,935, filed December 12, 1989, now patent No. 5,002,038.--.

Signed and Sealed this

Thirty-first Day of August, 1993

Bruce Lehman

*Attest:*

BRUCE LEHMAN

*Attesting Officer*

*Commissioner of Patents and Trademarks*